United States Patent [19]

van Laar et al.

[11] 3,984,089

[45] Oct. 5, 1976

[54] COOLED REFRACTORY LINED SHAFT FURNACE AND STAVE-COOLER TO BE USED THEREFORE

[75] Inventors: Jacobus van Laar, Santpoort; Jacob Felthuis, Oudorp, both of Netherlands

[73] Assignee: Hoogovens Ijmuiden B. V., Ijmuiden, Netherlands

[22] Filed: Mar. 12, 1974

[21] Appl. No.: 450,388

[30] Foreign Application Priority Data

Mar. 19, 1973 Netherlands ..... 7303769

[52] U.S. Cl. ..... 266/193; 266/286

[51] Int. Cl.[2] ..... F27B 1/24

[58] Field of Search ..... 266/25, 32, 43, 190, 266/193, 286

[56] References Cited

UNITED STATES PATENTS

| | | | |
|---|---|---|---|
| 350,981 | 10/1886 | Kennedy | 266/43 |
| 1,027,738 | 5/1912 | Ladd et al | 266/32 |
| 1,090,574 | 5/1914 | Shannon | 266/32 |
| 3,379,427 | 4/1968 | Zherebin | 266/32 |
| 3,586,304 | 6/1971 | Greaves | 266/32 |
| 3,652,070 | 3/1972 | Sagara | 266/32 |

FOREIGN PATENTS OR APPLICATIONS

| | | | |
|---|---|---|---|
| 1,156,280 | 5/1958 | France | 266/32 |
| 1,111,657 | 7/1961 | Germany | 266/32 |
| 47-4765 | 7/1967 | Japan | 266/32 |
| 8,571 | 6/1891 | United Kingdom | 266/32 |

OTHER PUBLICATIONS

Publication: Foundry; Dec. 1951; J. P. Holt; pp. 93–94.

*Primary Examiner*—Roy Lake
*Assistant Examiner*—Paul A. Bell
*Attorney, Agent, or Firm*—Stevens, Davis, Miller & Mosher

[57] ABSTRACT

In a shaft furnace which has a wall comprising of a shell and stave-coolers inside the shell, and a refractory lining of the wall supported by projections (supporting cams) on the stave-coolers, there are provided special bricks, preferably of material of superior refractoriness, strength, chemical resistance and wear-resistance, which rest on the projections and extend beyond the projections both towards and away from the shell. The bricks are fixed in the furnace wall, for instance by means of a ramming mass, and are preferably received in recessed in the stave-coolers.

10 Claims, 3 Drawing Figures

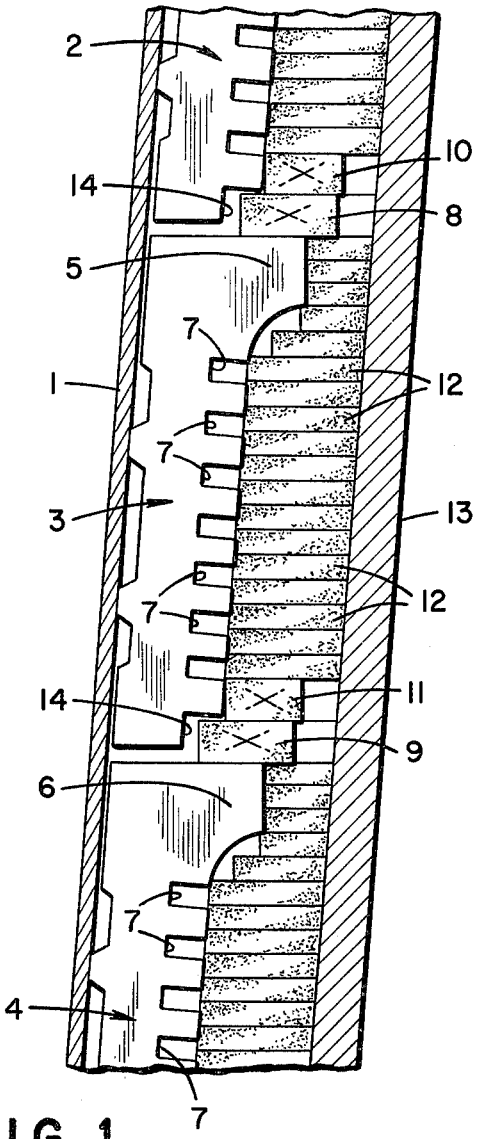
FIG. 1
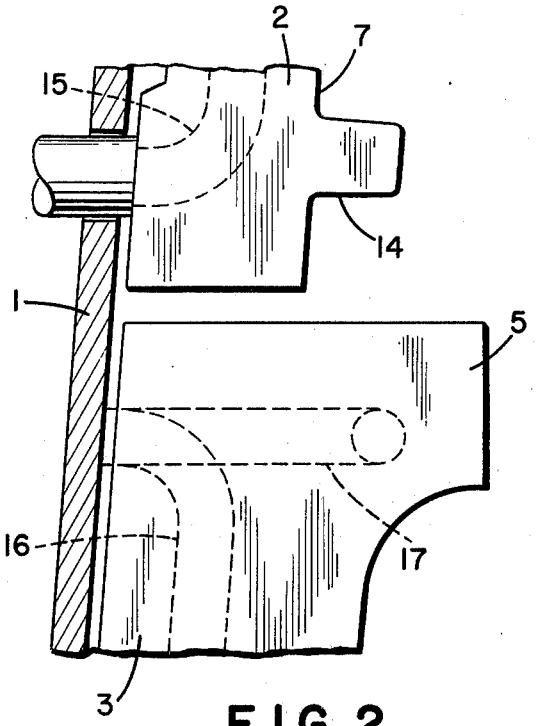
FIG. 2
FIG. 3
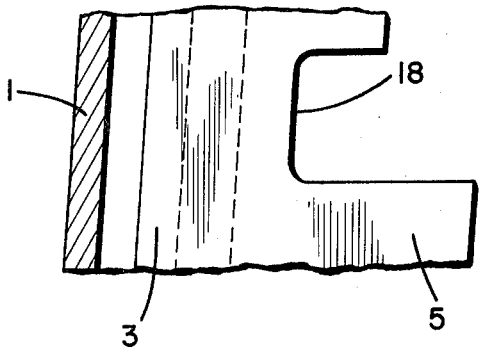

COOLED REFRACTORY LINED SHAFT FURNACE AND STAVE-COOLER TO BE USED THEREFORE

This invention relates to a cooled and refractory lined shaft furnace, more particularly a shaft furnace having a wall including a shell, stave-coolers inside the shell and a refractory lining supported by projections or supporting cams on the stave-coolers. The invention also relates to a stave-cooler to be used in such a shaft furnace.

The invention will be in the main be described and explained in this description with reference to its application to a blast furnace, but it is not restricted to this application and may be analogously applied to other types of shaft furnace in which cooling of the shaft is required.

Apart from other methods for cooling the wall of a blast-furnace, in recent years particular interest has arisen in constructions in which cooling panels having provision for circulation of cooling fluid are attached to the inside of the steel mantle of the furnace, i.e. to the so-called shell.

These cooling panels, referred to in English as "stave-coolers", and in German literature as "Plattenkühler", consist mainly of cast-iron slabs, which are closely connected one to the other and are attached to the shell. Also, in between the staves and the shell there is often provided a layer of refractory and thermally insulating material. Circulation channels are provided in the stave-coolers, usually in the form of cast-in tubes, which channels are connected together at the outside of the furnace to form an integrated system of channels. Through this system of channels a cooling liquid, a cooling gas, or a mixture of cooling liquid and vapour can be circulated.

A particular problem arising with the application of this construction to a blast furnace lies in the stability of the refractory lining against the stave-coolers where the shaft tapers upwardly. This is because the lining in this region has no tendency to lean against the wall of the furnace under its own weight, and special means are therefore necessary to increase stability. This also holds true for operating conditions in which part of the lining has been attacked, or has been replaced by attached slags. For this reason at the inside of the stave-coolers projections or supporting cams have been provided, which serve to support the lining. As these projections extend further into the furnace than the remainder of the stave-coolers, heatflow concentrates particularly on them, making special cooling necessary. This may be obtained by means of a separate tube through the supporting cam.

In order to achieve satisfactory support of the lining it has been proposed to make the supporting cam so long, and hence have it projecting so far into the lining, that the lining rests over substantially its entire depth upon the supporting cam. A drawback of the construction is that the front end of the supporting cam is located where the temperature in the lining can reach very high values, which may result in damage to the supporting cam. If the supporting cam is exposed to a very heavy thermal load, it may become necessary to disconnect the flow of cooling fluid through it, in order to prevent explosions in the furnace. The result is further thermal attack on the supporting cam, which can even lead to damage of the stave-cooler, and at any rate badly affects the support function of the supporting cam.

It is conceivable, in order to avoid this disadvantage, to make the supporting cam especially short, thus keeping its front end sufficiently cool, or even to avoid the use of a supporting cam at all, in which case there is used a supporting brick which only reaches into a groove. This arrangement, however, has the drawback that insufficient support of the lining is obtained, which may result in shearing of the lining, or even complete loss of contact between the lining and the stave-coolers. Also the danger then arises that the insufficiently supported brick breaks if its attachment is tight, or disintegrates because of high thermal strains. For, the lesser contact with the cooled supporting-cam results in a higher and more variable temperature gradient in the brick.

The present invention seeks to avoid, or to mitigate, the disadvantages of the use of too long or too short supporting cams or projections on the stave-coolers.

According to this invention, in one aspect, there is provided a shaft furnace having a cooled wall comprising a shell and a plurality of stave-coolers inside the shell, there being a refractory lining of the wall supported by projections on the inside faces of at least some of the stave coolers, the lining including, for each said projection, a refractory brick fixed in the cooled wall and resting on the projection and extending beyond the projection both towards and away from the shell. The brick should desirably be of superior quality as to refractoriness, strength, chemical resistance and wear resistance and may be superior in some or all of these respects to all or most of the remainder of the lining. The superior qualities of refractoriness, strength, chemical and wear resistance selected for the special bricks will be the qualities required having regard to the conditions to be encountered in the particular furnace. It is preferred that the brick is secured in the cooled wall by means of a ramming mass.

With this arrangement, the supporting effect of the projection is extended to a greater depth in the lining. The brick when fixed in the cooled wall at its rear end, i.e. its end or side closest to the shell cannot tilt about the front edge of the projection under the weight of the lining above. Thus advantages of a long projection may be obtained without the disadvantages.

Good results may be obtained if the brick is of a material having higher thermal conductivity than at least a major part of the remainder of the lining.

Preferably the brick is received, at its part extending beyond the projection towards the shell, in a recess in a stave-cooler. Where the projection is, as in some known stave-coolers, located away from the top end of the stave-cooler, the recess may be in the same stave-cooler as the projection on which the brick rests. For design reasons, a stave cooler may have its projection at or near the top of the stave-cooler, in which case there may be a recess to receive the brick at the bottom of the upwardly adjacent stave-cooler in the furnace. This arrangement has the additional advantage that the flow of heat through the stave-cooler near the recess is improved. Without that recess the cooling capacity of the stave-cooler in that region may be relatively small as compared with the supply of heat, thus causing a cooling problem. It has been stated already that the supporting brick should be of high quality, because it may reach almost to the firing-zone in the furnace, it is heavily loaded by the weight of the upper lining, and, once part of the refractory-lining has disappeared through wear, it can also be subject to wear caused by the furnace load, rubbing along it. It has been found that very good results are obtainable by selecting a material for the brick which consists substantially of SiC.

An advantage of the use of a brick of a high-quality refractory material is that the brick affords an extra protection to the projection both against super-heating and against wear. Though the brick should be fixed with its rear-end in the cooled wall, in order to prevent tilting, nevertheless it has been found to be advisable to provide the brick with sufficient support underneath it. Thus preferably, the centre of gravity of the brick is vertically above the projection.

A further improvement may be achieved if the brick has a second brick of the same material resting upon it. This second brick assists in transferring the weight of the lining above more evenly onto the first brick.

According to the invention in another aspect there is provided a stave-cooler for use in a shaft furnace according to the invention as described above, having a projection on its face which is inner in use for supporting the refractory lining of the furnace, and a recess in its said inner face located so as to be adjacent the next lower projection on a stave-cooler in the furnace. Thus if the projection is away from the upper end of the stave-cooler, the recess will be in the stave-cooler adjacent the projection. Where on the other hand the projection is at the top end of the stave-cooler, the recess may be a rabbet at the bottom end of the stave-cooler so as to be adjacent the projection of the next lower stave-cooler in the furnace, i.e. the bottom end is recessed step-wise.

It has already been stated that it is an advantage of the present invention that the projection may be relatively short. Nevertheless it should not be so short that insufficient support of the brick resting upon it results. Good results are obtainable in embodiments of the invention if the projection extends about 10cm from the inner face of the stave-cooler.

Two embodiments of the invention will now be described by way of example with reference to the accompanying drawing, in which:

FIG. 1 is a schematic vertical section through a part of a wall of a shaft furnace embodying the invention;

FIG. 2 shows some parts of the wall of FIG. 1 in more detail and on a larger scale; and FIG. 3 shows some parts of a wall of another shaft furnace embodying the invention, corresponding parts being given the same reference numerals as in FIGS. 1 and 2.

The shaft shown in FIG. 1 is a blast furnace shaft and has a cooled, refractory lined wall consisting of an outer steel shell 1 and three metal stave-coolers 2, 3, 4 attached to the shell 1 by mounting means which are not shown specially in the figure, but are of usual design.

Supporting-cams or projections 5, 6 are provided at the upper ends of the stave-coolers 3, 4. Through the stave-coolers and the supporting-cams tubes (not shown in FIG. 1), which are connected to a circuit for circulation of a cooling-fluid, are provided. To the inner side (the front side) the stave-coolers have crenel-shaped (rectangular) recesses 7, which are filled with refractory material. Lining-supporting refractory bricks 8, 9 rest upon the supporting-cams 5, 6. These bricks consist of silicon-carbide. The bricks 8, 9 fit into recesses 14 in the form of rebates at the lower end of the inner faces of the upwardly adjacent stave-coolers. The lengths of the supporting cams and of the supporting bricks in the direction towards and away from the shell 1 is selected so that the bricks 8, 9 rest for over half of their length upon the supporting cams 5 and 6.

The centre of gravity of each brick is vertically above the supporting-cam, and the brick projects beyond the cam both towards and away from the shell 1. The bricks 8, 9 are themselves covered by second silicon-carbide bricks 10, 11. Bricks 10, 11 are shown in FIG. 1 to extend further into the furnace than do bricks 8, 9. This is not essential, however, as they also may extend equally far towards the interior of the furnace. The remainder of the refractory lining of the furnace wall consists of chamotte-bricks 12, covered by a wear lining 13. Instead of a lining of chamotte bricks, a lining of other material may be used; for instance the entire wall may be lined with silicon-carbide bricks.

In FIG. 2 the region of the recess 14 and the supporting-cam 5 is shown on an enlarged scale. The paths of the cooling tubes 15, 16, 17 through the stave-coolers are indicated schematically by broken lines. Though the supporting bricks 8 may in principle be fixed in position loosely on top of the supporting cam 5 and in the recess 14, it is explicitly recommended that the grooves remaining should be closed with a ramming mass. Ramming masses of known type which are somewhat compressible, are preferred, in order that thermal expansions of the stave-coolers or the bricks may be taken up in the grooves. It is also clearly shown in the drawing that the cooling tube 15 is closer to the surface of the stave-cooler if there is the recess 14, than if there is no such recess. This reduces the possibility of local super-heating of the stave-cooler.

In FIG. 3 an arrangement of the projection and its associated recess different from that of FIG. 2 is shown. The projection or supporting-cam 5 is not provided at the upper end of the stave-cooler, but at some intermediate position in the height of the stave-cooler. The stave-cooler is somewhat recessed immediately above the supporting-cam, to provide a recess 18, which serves to receive the supporting-brick 8.

What we claim is:

1. Shaft furnace having a cooled wall comprising a shell and a plurality of stave-coolers inside the shell, there being a refractory lining of the wall supported by projections on the inside faces of at least some of the stave coolers, the lining including, for each said projection, a refractory brick fixed in the cooled wall and resting on the projection and extending beyond the projection both towards and away from the shell, each said brick being received, at its part extending beyond the projection towards the shell, in a recess in a stave-cooler.

2. Shaft furnace according to claim 1 wherein the said recess is in the same stave-cooler as the projection on which the brick rests.

3. Shaft furnace according to claim 1 wherein the projection is at the top of the stave-cooler and the said recess which receives the brick is provided in the form of a rabbet at the bottom of an upwardly adjacent stave-cooler.

4. Shaft furnace according to claim 1 wherein the said brick has superior refractoriness, strength, chemical resistance and wear-resistance in comparison with alumine-silicate bricks generally used for blast furnace lining.

5. Shaft furnace according to claim 1 wherein the said brick is of material having higher thermal conductivity than at least a major part of the remainder of the material of the lining.

6. Shaft furnace according to claim 1 wherein the said bricks are fixed in the cooled wall by means of a ramming mass.

7. Shaft furnace according to claim 1 wherein the projections are arranged to be cooled by the passage of coolant within them.

8. Shaft furnace according to claim 1 wherein the said bricks consist substantially of SiC.

9. Shaft furnace according to claim 1 wherein the centre of gravity of the brick is vertically above the projection.

10. Shaft furnace according to claim 1 wherein the said brick has a second brick of the same material resting upon it.

* * * * *